US011970797B2

(12) United States Patent
Luckey

(10) Patent No.: US 11,970,797 B2
(45) Date of Patent: Apr. 30, 2024

(54) MANUALLY-ADVANCED CYLINDER, WITH AN ADJUSTABLE POINTER, FOR CONTINUOUS TRACKING OF TREADLING ON A WEAVING DRAFT WHEN WEAVING WITH A HAND-OPERATED LOOM

(71) Applicant: Alan Wayne Luckey, Indiana, PA (US)

(72) Inventor: Alan Wayne Luckey, Indiana, PA (US)

( * ) Notice: Subject to any disclaimer, the term of this patent is extended or adjusted under 35 U.S.C. 154(b) by 0 days.

(21) Appl. No.: 17/841,087

(22) Filed: Jun. 15, 2022

(65) Prior Publication Data

US 2023/0407534 A1 Dec. 21, 2023

(51) Int. Cl.
*D03J 1/10* (2006.01)
*D03D 29/00* (2006.01)

(52) U.S. Cl.
CPC ..... *D03J 1/10* (2013.01); *D03D 29/00* (2013.01)

(58) Field of Classification Search
CPC ..... D03D 29/00; D03J 1/10; D04B 3/00
USPC ..... 139/1 R, 29
See application file for complete search history.

(56) References Cited

U.S. PATENT DOCUMENTS 61,531 A 1/1867 Freetsha
511,913 A * 1/1894 Smith et al. ..... D03D 39/10 139/57
556,316 A * 3/1896 Morgan ..... D03C 3/24 139/330
645,562 A 3/1900 Harwick
2,600,128 A * 6/1952 Reynolds, Sr. ..... D03C 1/22 139/321
2,725,900 A * 12/1955 Leuszler ..... D03D 29/00 139/30
3,935,629 A * 2/1976 Piro ..... D04B 37/04 66/1 R
3,998,246 A 12/1976 Strousser
4,074,726 A * 2/1978 Harris ..... D03D 29/00 139/29
4,301,839 A * 11/1981 Yamaguchi ..... D03D 29/00 139/29
4,391,591 A * 7/1983 Hamburger ..... G09B 19/20 434/95

FOREIGN PATENT DOCUMENTS

FR 1557705 A * 2/1969 ..... D04B 3/00
FR 2838456 A1 * 10/2003 ..... D04B 3/00
GB 633051 A * 12/1949 ..... D04B 3/00
JP 04119149 A * 4/1992 ..... B65H 49/325

* cited by examiner

*Primary Examiner* — Grace Huang
(74) *Attorney, Agent, or Firm* — Michael G. Monyok

(57) ABSTRACT

The object of the invention is to enable the weaver to weave the design structure of fabric without having to remember where one is on the treadling draft (a diagrammatic representation of the treadling order). This invention not only enables the weaver to weave without mistakes but also to stop weaving for any time period and resume weaving without having to examine the previously woven cloth, thus ensuring that the pattern of the weaving continues as designed.

Figure 1:
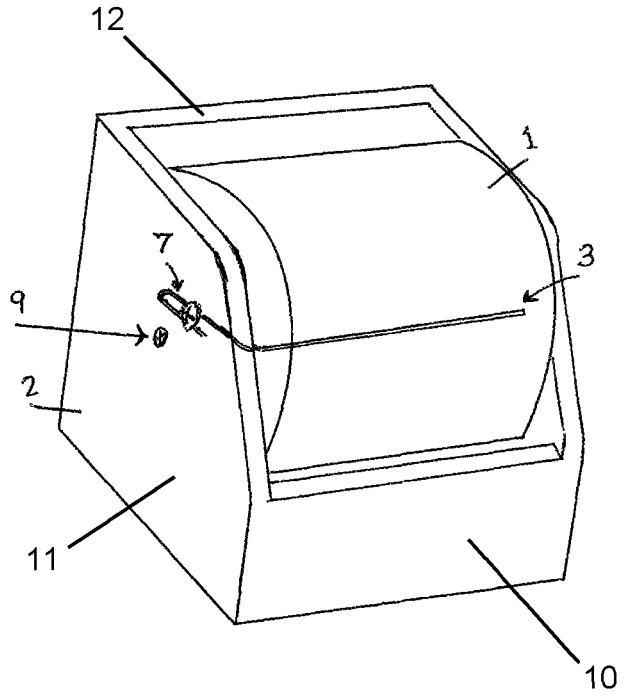

When any draft is taped onto the cylinder, the weaver is able to rotate the cylinder and thus the draft, keeping track of each treadling by the draft's alignment with the pointer.

This invention is designed to assist the weaver to always know where to begin the next treadling, based upon the pointer's position on the draft, thereby enabling the weaver to continue to weave, without mistakes, the prescribed design of woven fabric.

5 Claims, 1 Drawing Sheet

MANUALLY-ADVANCED CYLINDER, WITH AN ADJUSTABLE POINTER, FOR CONTINUOUS TRACKING OF TREADLING ON A WEAVING DRAFT WHEN WEAVING WITH A HAND-OPERATED LOOM

BACKGROUND OF THE INVENTION

This invention relates to the field of weaving on a conventional, manually-operated loom. Weaving is an ancient art or craft to intertwine horizontal and vertical threads to produce an interwoven fabric.

This apparatus provides a weaver, who weaves on a manually-operated loom, not a mechanical, computerized, or computer-assisted loom, with a tool to keep track of the sequence of treadling when weaving fabric. This invention is a device to continuously point to the weaving pattern, while weaving. The CPC class is D03J 1/10. While not similar to the invention, U.S. Pat. No. 3,998,246 is prior art which also is a method of keeping track of weaving operations, both simple and complex.

Internet-based social media outlets are replete with examples of conversations among weavers about how to keep track of the treadling pattern. A search of these internet-based blogs, e-journals, youtube videos, etc., demonstrates that such an apparatus as this invention is unknown.

As weaving progressed through the centuries, weavers began recording the weaving instructions using a draft, which is a document that graphically depicts how to thread the warp (lengthwise threads) through heddles of the loom, how to tie the harness of the loom to the treadles, the sequence or order of depressing the treadles to lift the harness to create a shed through which the weft (crosswise) thread passes, and the diagram of the woven structure. The draft of the treadling may be very simple, such as a plain weave or tabby, typically using only 2 shafts, not requiring memorization, or very complex (requiring four or multiples of four shafts) and which may be beyond the capacity of an average weaver to memorize.

To address the problem of either losing track of the treadling sequence or of not being able to re-establish where one is in the sequence of weaving a specific pattern, the invention negates the necessity of the weaver to remember the treadling pattern.

BRIEF SUMMARY OF THE INVENTION

This invention houses a compact cylinder 1, of a size that is easy for a weaver to turn by hand, yet will accept a printed or hand-drawn treadling draft of approximately 10⅝ inches, long enough for most drafts, to be affixed to the cylinder 1 with tape. The cylinder 1 is housed in a light frame 2 of a straight-grained, non-warping wood with an open bottom and top. The frame includes a pair of sides, wherein each side of the pair of sides has a pivot center permitting rotation of the rotating cylinder within the frame. The cylinder 1 rotates on recessed wood screws in the frame 2 at the pivot center. The front or face 10 of the frame 2, facing the weaver, is short enough for the weaver to clearly see the draft on the cylinder 1, yet tall enough to have any note helpful to the weaving affixed thereon with tape. The sides 11 and back 12 allow finger access to turn the cylinder 1.

Occasionally the weaver may use a treadling draft of such complexity that it exceeds 10⅝ inches. In this case the top of the draft can be taped to the cylinder 1, and also taped at about one quarter of the circumference, allowing the tail of the long draft to protrude out the slot in the lower back of the frame 2.

The wire pointer 3 can be mounted on either side of the frame 2, thus allowing the weaver unobstructed access to the cylinder 1 when rotating it with the weaver's preferred hand. So that the cylinder 1 does not move inadvertently and thereby corrupt the location of the draft under the pointer 3, an easily adjustable friction device 13 (4, 5, 6), located on the frame 2, allows the weaver to adjust the friction with a thumb screw 4.

In one embodiment, the weaving apparatus has a rotating cylinder configured to receive a treadling draft, where a frame supports the rotating cylinder. The frame has a face and a pair of side, where each side of the pair of side has a pivot center permitting rotation of the rotating cylinder within the frame. A friction device attached to the frame contacts the rotating cylinder. A pointer mounted with a screw to a side of the pair of sides may be included, wherein the pointer has an elongated opening and is adjustable at an attach point to the frame. The pointer is situated through a 90 degree arc, so that the pointer is in front or above the rotating cylinder. In an alternative embodiment, the friction device is a thumb screw threaded through the frame and a felt pad bearing against the rotating cylinder.

With all of these parts in concert, weavers are easily able to keep track of their position in the treadling draft, and thus in the fabric being woven, at all times. Distractions, or interruptions of any length of time, will have no effect on the proper weaving, as the pointer's position on the draft and thus the weaver's place in the weaving process, upon returning, is completely evident. It is no longer necessary for a weaver to attempt to remember the treadling sequence no matter how complex it may be.

It is to be understood that both the foregoing general description and the following detailed description are exemplary and explanatory only and are not restrictive of the invention, as claimed.

BRIEF DESCRIPTION DRAWINGS

FIG. 1 of the present invention is a front perspective showing the cylinder 1, the pointer 3, and its adjustable attach point 7.

Figure 2:
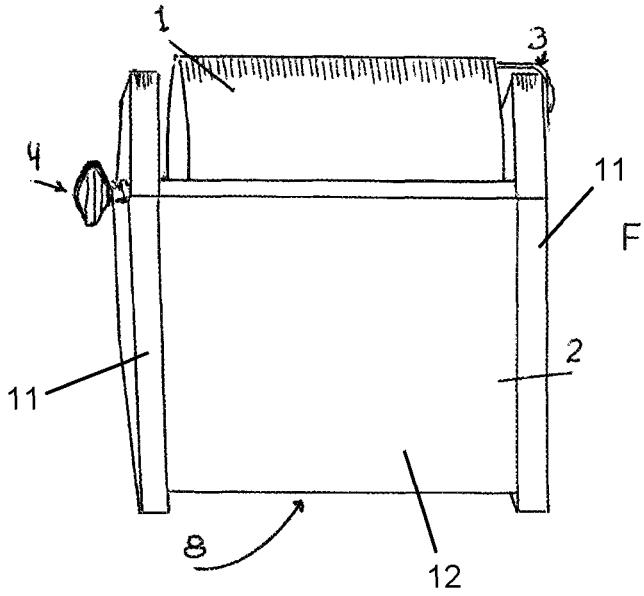

FIG. 2 of the present invention is a rear perspective showing the slot 8 in the bottom rear, rear, or back and the adjustable thumb screw 4.

Figure 3:
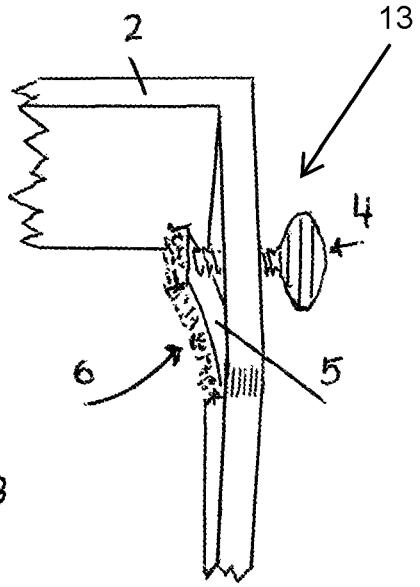

FIG. 3 of the present invention is a perspective of the partial view of the right rear corner of the frame 2, showing detail of the friction device 13 (4, 5, 6).

DETAILED DESCRIPTION OF THE INVENTION

The central part of the invention consists of a rotating cylinder 1, as shown in FIG. 1 and FIG. 2, sized to accommodate the taping thereon of most treadling drafts. Because many hand-weavers have an affinity for classic weaving traditions, the structure of the invention is wood. Clear maple, or some other hardwood, is turned on a lathe to a diameter of 3¼ inches, although the precise size of the cylinder 1 and associated frame may be flexible. A light frame 2 of straight-grained non-warping wood, as shown in FIG. 1, FIG. 2, and FIG. 3, with an open bottom and top, houses the cylinder 1. The corners of the frame 2 are glued and nailed to provide long-term stability. The rear 12 of the frame 2 is raised above the base approximately ¼ inch, shown in FIG. 2 as a raised slot 8. The cylinder 1 rotates within the framework by way of wood screws 9 in FIG. 1 in its pivot centers. The flathead screws are countersunk into the sides 11, just below the surface of the frame 2, with sufficient tension to allow the cylinder 1 to rotate freely, and not so loose as to allow it to move side to side.

A heavy wire metal pointer 3, as shown in FIG. 1 and FIG. 2, plated to prevent oxidation, is shaped in such a way that its position is easily adjustable at attach point 7, shown in FIG. 1, to the weaver's preference, thus accommodating the weaver's visual sighting of the treadling draft, regardless of where the apparatus is placed. A screw hole for its attachment is provided in both sides 11 of the frame 2. An easily adjustable friction device 13 (4, 5, 6) contacts either the side or the circumference of the cylinder 1. This adjustable friction device 13, shown in FIG. 3, consists of a thumb screw 4, as shown in FIG. 2 and FIG. 3, threaded through the frame 2, with a tab of flexible plastic 5 between it and a tab of felt 6, which then bears against the cylinder 1.

REFERENCE CHARACTERS

1 cylinder
2 frame
3 pointer
4 thumb screw
5 plastic
6 felt
7 adjustable pointer attach point
8 raised slot
9 pivot screw
10 face
11 sides
12 back
13 friction device

The invention claimed is:

1. A weaving apparatus comprising:
a rotating cylinder configured to receive a treadling draft;
a frame supporting the rotating cylinder,
wherein the frame comprises a face and a pair of sides connected to the face,
wherein each side of the pair of sides has a pivot center permitting rotation of the rotating cylinder within the frame;
a friction device attached to the frame and contacting the rotating cylinder; and
a pointer mounted with a screw to a side of the pair of sides,
wherein the pointer has an elongated opening at an attach point to the frame,
wherein the pointer is adjustable at the attach point,
wherein the pointer is situated through a 90 degree arc, so that the pointer is in front of or above the rotating cylinder.

2. The weaving apparatus of claim 1, wherein the face has a height less than a diameter of the rotating cylinder to provide a weaver a clear view of the rotating cylinder when placed in front of the weaver.

3. The weaving apparatus of claim 1, wherein the frame further comprises:
a back connected to the pair of sides,
wherein the back forms a slot at a bottom portion of the frame.

4. The weaving apparatus of claim 1,
wherein the face has a height less than a height of the pair of sides; and
wherein a portion of the rotating cylinder is accessible at the pair of sides to allow access to turn the rotating cylinder.

5. A weaving apparatus comprising:
a rotating cylinder configured to receive a treadling draft;
a frame supporting the rotating cylinder,
wherein the frame comprises a face and a pair of sides connected to the face,
wherein each side of the pair of sides has a pivot center permitting rotation of the rotating cylinder within the frame; and
a friction device attached to the frame and contacting the rotating cylinder, the friction device comprising:
a thumb screw threaded through the frame;
a piece of felt bearing against the rotating cylinder; and
a tab of flexible plastic positioned between the thumb screw and the piece of felt.

* * * * *